US006085357A

United States Patent [19]

Broersma

[11] Patent Number: 6,085,357

[45] Date of Patent: Jul. 11, 2000

[54] HEADGEAR FITTING AND ACCESSORY SYSTEM

[75] Inventor: Lester Broersma, Jamul, Calif.

[73] Assignee: Troxel Cycling & Fitness, LLC, San Diego, Calif.

[21] Appl. No.: 09/057,836

[22] Filed: Apr. 9, 1998

[51] Int. Cl.[7] ..... A42B 3/00

[52] U.S. Cl. ..... 2/416; 2/417; 2/420

[58] Field of Search ..... 2/181, 181.2, 181.4, 2/182.1, 182.2, 183, 414, 416, 417, 418, 419, 420, 421, 195.2

[56] References Cited

U.S. PATENT DOCUMENTS

| | | | |
|---|---|---|---|
| 5,113,534 | 5/1992 | Lane et al. | 2/416 |
| 5,581,819 | 12/1996 | Garneau | 2/421 |
| 5,659,900 | 8/1997 | Arney et al. | 2/417 |
| 5,898,949 | 5/1999 | Barthold et al. | 2/416 |

OTHER PUBLICATIONS

Cover page of U.S. Patent No. 4,477,929 of Mattsson, issued Oct. 23, 1984.

Cover page of U.S. Patent No. 5,012,533 of Raffler, issued May 7, 1991.

Cover page of U.S. Patent No. 4,539,715 of Clement, issued Sep. 10, 1985.

Cover page of U.S. Patent No. 4,404,690 of Farquharson, issued Sep. 20, 1983.

Cover page of U.S. Patent No. 5,226,180 of Leach, issued Jul. 13, 1993.

Cover page of U.S. Patent No. 3,882,546 of Morton, issued May 13, 1975.

Cover page of U.S. Patent No. 4,016,734 of Morton, issued Apr. 12, 1977.

Cover page of U.S. Patent No. 4,051,555 of Daly, issued Oct. 4, 1977.

Cover page of U.S. Patent No. 3,590,388 of Holt, issued Jul. 6, 1971.

Cover page of U.S. Patent No. 3,344,433 of J.A. Stapenhill, issued Oct. 3, 1967.

Cover page of U.S. Patent No. 3,289,212 of G.E. Morgan, issued Dec. 6, 1966.

Cover page of U.S. Patent No. 2,768,380 of D.L. Golomb, issued Oct. 30, 1956.

Cover page of U.S. Patent No. 3,859,666 of Marietta et al., issued Jan. 14, 1975.

Cover page of U.S. Patent No. 5,572,749 of Ogden, issued Nov. 12, 1996.

Cover page of U.S. Patent No. 4,766,614 of Cantwell et al., issued Aug. 30, 1988.

(List continued on next page.)

*Primary Examiner*—John J. Calvert
*Assistant Examiner*—Katherine Moran
*Attorney, Agent, or Firm*—Walter W. Duft

[57] ABSTRACT

A headgear fitting and accessory system is disclosed for use with headgear having a forward portion, a rearward portion, two lateral portions, a continuous lower rim and an upper crown. The headgear fitting and accessory system includes a flexible pad configured to be positioned within the interior of the headgear. The pad has a lower ring-forming portion configured for placement adjacent the headgear lower rim. The pad may incorporate one or more suspension straps extending from the lower ring-forming portion and configured for placement adjacent the headgear upper crown. The pad may also be provided with one or more sizing flaps pivotally connected to the lower ring-forming portion and configured for placement between a folded position wherein the sizing flaps are folded between the ring-forming portion and the headgear, and an unfolded position wherein the sizing flaps are not folded between the ring-forming portion and the headgear. One or more stays are provided which are configured for mounting to the headgear and for releasably engaging the pad. The stays allow the pad to be secured within the head gear and permit adjustment of the suspension straps, if present. A retention strap and strap retainer arrangement may also be added to provide a closed loop, non-buckling retention system that can be adjusted to fit heads of different size without breaking the closed loop.

14 Claims, 7 Drawing Sheets

OTHER PUBLICATIONS

Cover page of U.S. Patent No. 3,495,272 of H. Tempelhof, issued Feb. 17, 1970.
Cover page of U.S. Patent No. 5,079,780 of Coombs et al., issued Jan. 14, 1992.
Cover page of U.S. Patent No. 4,942,628 of Freund, issued Jul. 24, 1990.
Cover page of U.S. Patent No. 4,888,831 of Oleson, issued Dec. 26, 1989.
Cover page of U.S. patent No. Re. 32,569 of Aileo et al., issued Jan. 05, 1988.
Cover page of U.S. Patent No. 4,443,891 of Blomgren et al., issued Apr. 24, 1984.
Cover page of U.S. Patent No. 4,293,960 of Palmaer, issued Oct. 13, 1981.
Cover page of U.S. Patent No. 4,263,679 of Erlendson, issued Apr. 04, 1981.
Cover page of U.S. Patent No. 3,897,596 of Aileo et al., issued Aug. 05, 1975.
Cover page of U.S. Patent No. 3,465,363 of D.F. Raney, issued Sep. 09, 1969.
Cover page of U.S. Patent No. 3,447,162 of J.A. Aileo, issued Jun. 03, 1969.
Cover page of U.S. Patent No. 5,517,698 of Nault et al., issued May 21, 1996.
Cover page of U.S. Patent No. 5,269,025 of Broersma, issued Dec. 14, 1993.
Cover page of U.S. Patent No. 5,099,523 of Broersma, issued Mar. 31, 1992.
Cover page of U.S. Patent No. 2,964,753 of H.W. Austin, issued Dec. 20, 1960.
Cover page of U.S. Patent No. 2,964,754 of H.W. Austin, issued Dec. 20, 1960.
Cover page of U.S. Patent No. 3,018,483 of H.W. Austin, issued Jan. 30, 1962.
Cover page of U.S. Patent No. 3,950,788 of Lamb, issued Apr. 20, 1976.
Cover page of U.S. Patent No. 3,619,814 of J. Aileo, issued Nov. 16, 1971.
Cover page of U.S. Patent No. 3,389,405 of L.A. Fattori, issued Jun. 25, 1968.
Cover page of U.S. Patent No. 3,329,968 of D.W. Gordon, issued Jul. 11, 1967.
Cover page of U.S. Patent No. 3,154,788 of J.N. Simpson, issued Nov. 03, 1964.
Cover page of U.S. Patent No. 2,117,764 of G.E. Holmes, issued May 17, 1938.
Cover page of U.S. Patent No. 5,044,019 of Shewchenko et al., issued Sep. 03, 1991.
Cover page of U.S. Patent No. 4,056,852 of Greendale, issued Nov. 08, 1977.
Cover page of U.S. Patent No. 3,994,023 of Aileo et al., issued Nov. 30, 1976.
Cover page of U.S. Patent No. 3,696,440 of Littleton, issued Oct. 10, 1972.
Cover page of U.S. Patent No. 3,696,441 of Littleton, issued Oct. 10, 1972.
Cover page of U.S. Patent No. 4,796,309 of Nava, issued Jan. 10, 1989.
Cover page of U.S. Patent No. 3,706,101 of Plastino, issued Dec. 19, 1972.
Cover page of U.S. Patent No. 3,735,418 of Kavanagh et al., issued May 29, 1973.
Cover page of U.S. Patent No. 3,878,562 of Lamb, issued Apr. 22, 1975.
Cover page of U.S. Patent No. 4,453,277 of Durand et al., issued Jun. 12, 1984.
Cover page of U.S. Patent No. 5,437,064 of Hamaguchi, issued Aug. 01, 1995.
Cover page of U.S. Patent No. 5,551,094 of Navone, issued Sep. 03, 1996.
Cover page of U.S. Patent No. 3,020,551 of H.W. Austin, issued Feb. 13, 1962.
Cover page of U.S. Patent No. 3,092,837 of H.W. Austin, issued Jun. 11, 1963.
Cover page of U.S. Patent No. 3,110,900 of G.J. Crowdes, Jr., issued Nov. 19, 1963.
Cover page of U.S. Patent No. 3,714,668 of Mirabella, issued Feb. 06, 1973.
Cover page of U.S. Patent No. 4,833,735 of Long et al., issued May 30, 1989.
Cover page of U.S. Patent No. Re. 34,699 of Copeland et al., re–issued Aug. 23, 1994.
Cover page of U.S. Patent No. 5,093,936 of Copeland et al., issued Mar. 10, 1992.
Cover page of U.S. Patent No. 5,575,017 of Hefling et al., issued Nov. 19, 1996.
Cover page of U.S. Patent No. 5,511,250 of Field et al., issued Apr. 30, 1996.
Cover page of U.S. Patent No. 4,292,692 of Moretti et al., Oct. 06, 1981.
Cover page of U.S. Patent No. 4,117,554 of Palumbo, issued Oct. 03, 1978.
Cover page of U.S. Patent No. 3,992,720 of Nicolinas, issued Nov. 23, 1976.
Cover page of U.S. Patent No. 3,787,894 of Goodman, Jr., issued Jan. 29, 1974.
Cover page of U.S. Patent No. 3,609,764 of G.E. Morgan, issued Oct. 05, 1971.
Cover page of U.S. Patent No. 3,882,547 of Morgan, issued May, 13, 1975.
Cover page of U.S. Patent No. 4,124,904 of Matthes, issued Nov. 14, 1978.
Cover page of U.S. Patent No. 3,992,721 of Morton, issued Nov. 23, 1976.
Cover page of U.S. Patent No. 4,044,399 of Morton, issued Aug. 30, 1977.
Cover page of U.S. Patent No. 4,345,338 of Frieder, Jr. et al., issued Aug.24, 1982.
Cover page of U.S. Patent No. 4,020,507 of Morton, issued May 03, 1977.
Cover page of U.S. Patent No. 4,343,047 of Lazowski et al., issued Aug. 10, 1982.
Cover page of U.S. Patent No. 3,713,640 of Margan, issued Jan. 30, 1973.
Cover page of U.S. Patent No. 5,014,365 of Schulz, issued May 14, 1991.
Cover page of U.S. Patent No. 3,761,959 of Dunning, issued Oct. 02, 1973.
Cover page of U.S. Patent No. 5,181,279 of Ross, issued Jan. 26, 1993.
Cover page of U.S. Patent No. 3,866,243 of Morgan, issued Feb. 18, 1975.
Cover page of U.S. Patent No. 4,287,613 of Schultz, issued Sep. 08, 1981.
Cover page of U.S. Patent No. 4,100,320 of Chisum, issued Jul. 11, 1978.

Cover page of U.S. Patent No. 3,956,773 of Chisum, issued May 18, 1976.
Cover page of U.S. Patent No. 5,324,460 of Briggs, issued Jun. 28, 1994.
Cover page of U.S. Patent No. 5,056,162 of Tirums, issued Oct. 15, 1991.
Cover page of U.S. Patent No. 4,432,099 of Grick et al., issued Feb. 21, 1984.
Cover page of U.S. Patent No. 4,433,494 of Courvoisier et al., issued Feb. 28, 1984.
Cover page of U.S. Patent No. 4,412,358 of Lavender, issued Nov. 01, 1983.
Cover page of U.S. Patent No. 4,239,106 of Aileo, issued Dec. 16, 1980.
Cover page of U.S. Patent No. 4,290,149 of Aileo, issued Sep. 22, 1981.
Cover page of U.S. Patent No. 3,729,744 of Rappleyea, issued May 01, 1973.
Cover page of U.S. Patent No. 3,820,163 of Rappleyea, issued Jun. 28, 1974.
Cover page of U.S. Patent No. 3,665,514 of Durand, issued May 30, 1972.
Cover page of U.S. Patent No. 3, 629,864 of Latina, issued Dec. 28, 1971.
Cover page of U.S. Patent No. 3,631,539 of Massa, issued Jan. 04, 1972.
Cover page of U.S. Patent No. 3,579,637 of J.A. Aileo, issued May 25, 1971.
Cover page of U.S. Patent No. 5,337,420 of Haysom et al., issued Aug. 16, 1994.

FIG. 1
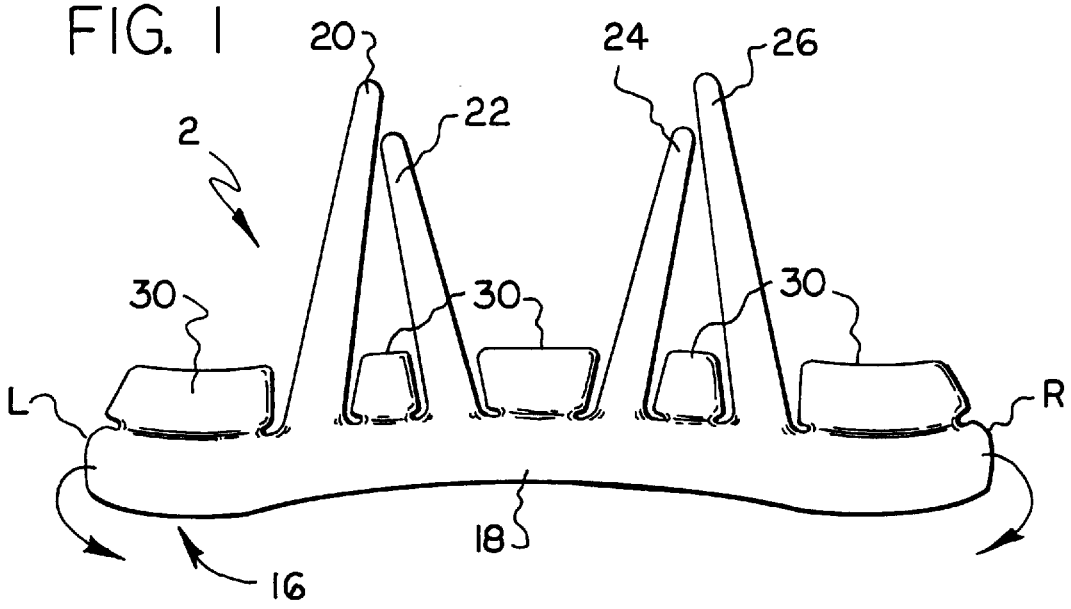
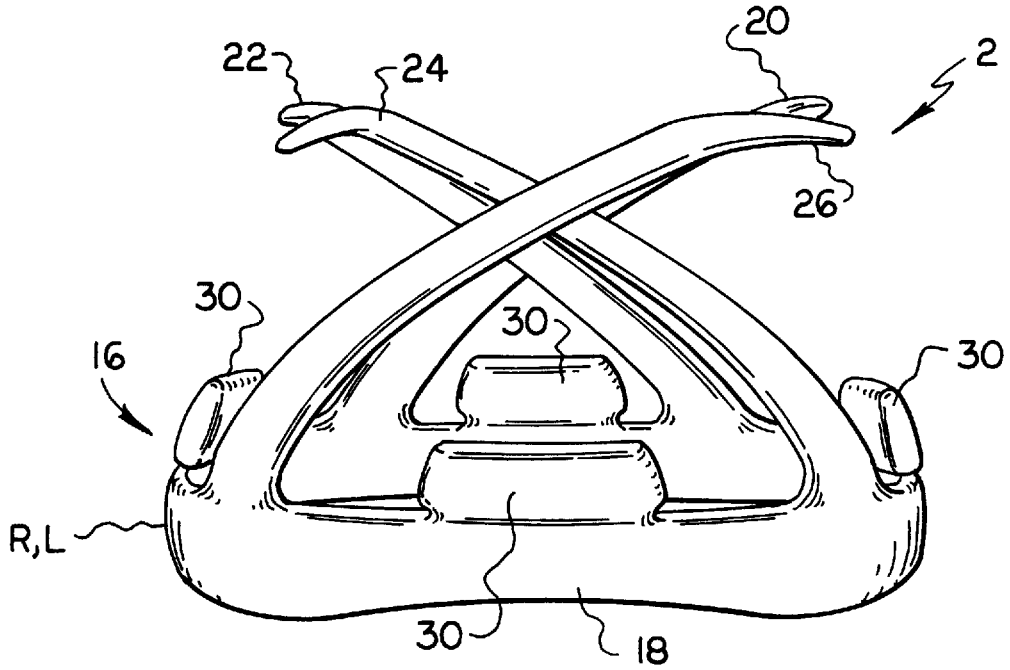
FIG. 2

FIG. 3
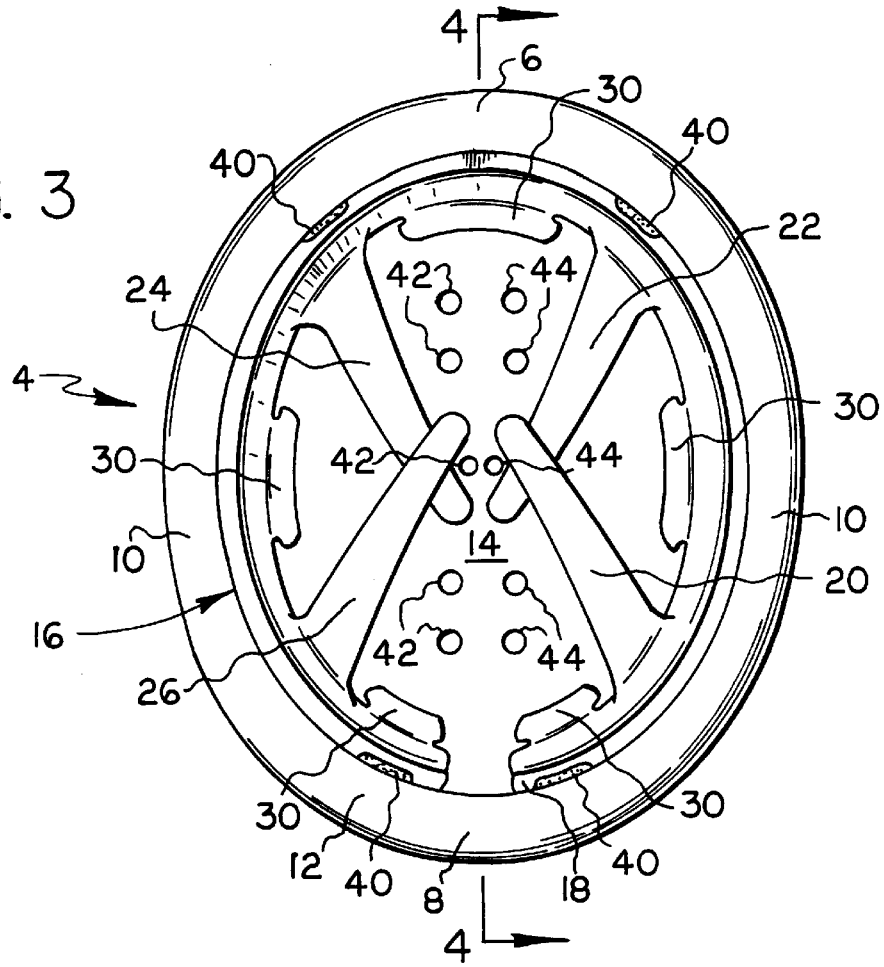
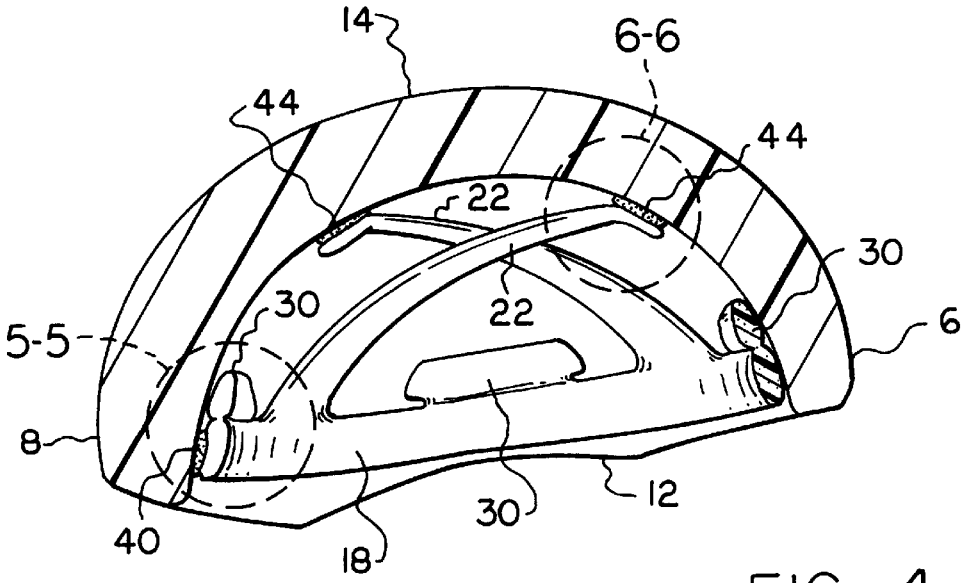
FIG. 4

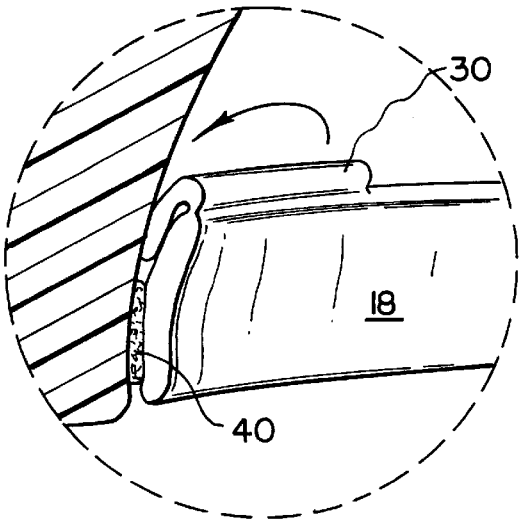
FIG. 5
FIG. 6
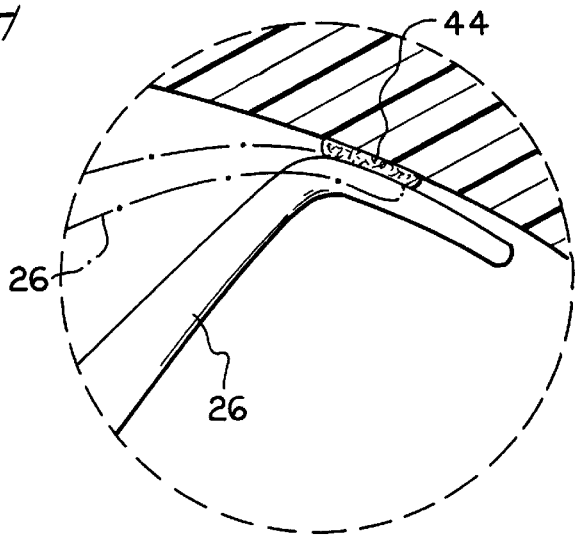
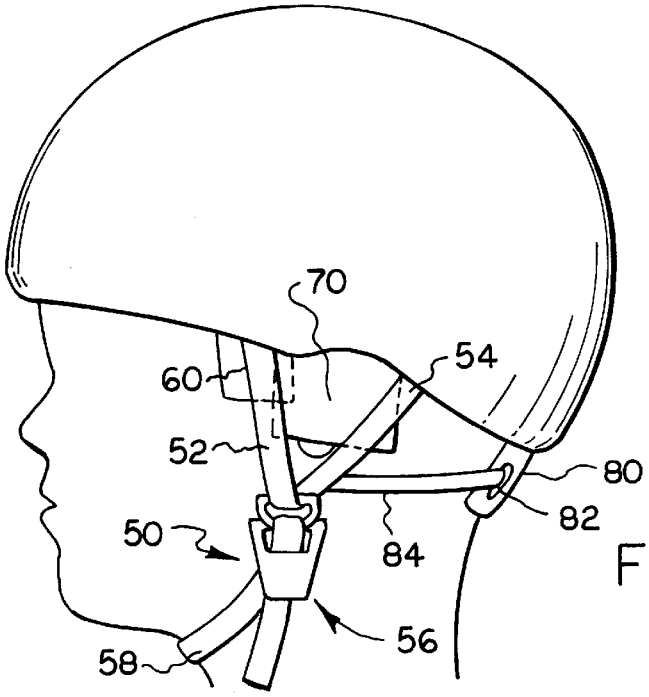
FIG. 7

HEADGEAR FITTING AND ACCESSORY SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The invention relates to protective headgear, and particularly helmets. More specifically, the invention is directed to a system for fitting, positioning and securing protective headgear on a wearer's head. Still more particularly, the invention concerns a headgear insert that allows the size and position of the headgear to be adjusted for use by a variety of wearers, regardless of head size and shape, and a retention member that allows the headgear to be secured without complicated strap and buckle adjustments.

2. Description of the Prior Art

There are many types of protective headgear which are presently in use for a variety of recreational activities and work-related uses. In order to be effective, headgear must properly fit the wearer. Experience has shown that headgear should ride comfortably on top of a wearer's head with approximately one (1) inch of space between the headgear lower front edge and the wearer's eyes. Headgear that is too small will not be comfortable, and may ride too high on the wearer's head. Headgear that is too large may sit too low on the wearer's head, and may be more likely to slip so as to possibly reduce its protective capabilities.

In view of the foregoing, protective headgear typically includes a liner or harness system that allows the headgear to be adjusted to fit heads of varying size and shape. Such systems include adjustable straps and webs, and in many cases also include pads of varying thickness. The pads serve as accessories that can be removably inserted into the helmet interior and affixed using fasteners of various type. By adding pads of increasing thickness, the headgear can be made smaller. Conversely, headgear size can be increased by introducing thinner pads, or by removing one or more pads altogether. In either case, various strap adjustments may also be necessary to achieve a proper fit. This may entail the unfastening and refastening of various stays, ties or buckles, which are used to restrain the straps in position.

Although the prior art systems generally function effectively once the headgear is correctly adjusted, they suffer from several disadvantages. First, the adjustment of straps and buckles, and the selection and placement of multiple accessory pads, is relatively time consuming. Second, in headgear employing accessory pads, the headgear owner must keep track of the spare pads throughout the life of the headgear, if future adjustability is desired. If the pads are lost, they must be replaced before further downward size adjustments can be made.

Accordingly, it would be desirable to provide a headgear fitting and accessory system that avoids the use of complicated strap and buckle adjustments and removable accessory pads. What is required is a system for headgear that allows a user to adjust both the circumferential size and shape of the headgear interior, and the vertical position of the headgear on a wearer's head, with minimal time and effort and without the need for removable accessories, such as sizing pads, that can become misplaced or lost. The system should facilitate the rapid fitting and securement of the headgear on a wearer's head with only minimal strap adjustments, and preferably with no buckle adjustments at all.

BRIEF SUMMARY OF THE INVENTION

It is an object of the present invention to provide a headgear fitting and accessory system of unique design.

It is a further object of the invention to provide a headgear fitting and accessory system that avoids the use of complicated strap adjustments and removable sizing pads.

It is a still further object of the invention to provide a system for headgear that allows a user to adjust both the circumferential size and shape of the headgear interior, and the vertical position of the headgear on a wearer's head, with minimal time and effort and without the need for removable accessories, such as sizing pads, that can be misplaced or lost.

It is a still further object of the invention to provide a system that facilitates the rapid fitting and securement of headgear on a wearer's head with only minimal strap adjustments, and with no buckle adjustments at all.

It is yet another object of the invention to provide a system for headgear that achieves the foregoing objectives in an efficient manner and at minimal cost.

In accordance with the present invention, a headgear fitting and accessory system is provided for use with headgear having a forward portion, a rearward portion, two lateral portions, a continuous lower rim and an upper crown. In a preferred embodiment of the invention, the headgear fitting and accessory system includes a flexible pad configured to be positioned within the interior of the headgear. The pad has a lower ring-forming portion configured for placement adjacent the headgear lower rim. The pad may incorporate one or more suspension straps extending from the lower ring-forming portion and configured for placement adjacent the headgear upper crown. In another aspect of the invention, the pad may be provided with one or more sizing flaps pivotally connected to the lower ring-forming portion and configured for placement between a folded position wherein the sizing flaps are folded between the ring-forming portion and the headgear, and an unfolded position wherein the sizing flaps are not folded between the ring-forming portion and the headgear. One or more stays are configured for mounting to the headgear and for releasably engaging the pad. The stays allow the pad to be secured within the headgear interior and permit adjustment of the suspension straps, if present. In a further aspect of the invention, a retention strap and strap retainer arrangement may be added to provide a closed loop, non-buckling retention system that can be adjusted to fit heads of different size without breaking the closed loop.

BRIEF DESCRIPTION OF THE SEVERAL VIEWS OF THE DRAWING

The foregoing and other features and advantages of the present invention will be apparent from the following more particular description of a preferred embodiment of the invention, as illustrated in the accompanying Drawing, in which:

FIG. 1 is a plan view of a headgear fitting and accessory system article constructed in accordance with the present invention and arranged in a two-dimensional assembly orientation;

FIG. 2 is a perspective view of the headgear fitting and accessory system article of FIG. 1 arranged in a three-dimensional operational orientation;

FIG. 3 is a bottom view of headgear incorporating a headgear fitting and accessory system constructed in accordance with the present invention;

FIG. 4 is a cross-sectional view taken along line 4—4 in FIG. 3;

FIG. 5 is an enlarged fragmentary detail view of a portion of FIG. 4;

FIG. 6 is an enlarged fragmentary detail view of another portion of FIG. 4;

FIG. 7 is a side view of headgear incorporating a headgear fitting and accessory system constructed in accordance with another aspect of the present invention;

DETAILED DESCRIPTION OF THE INVENTION

Figure 8:
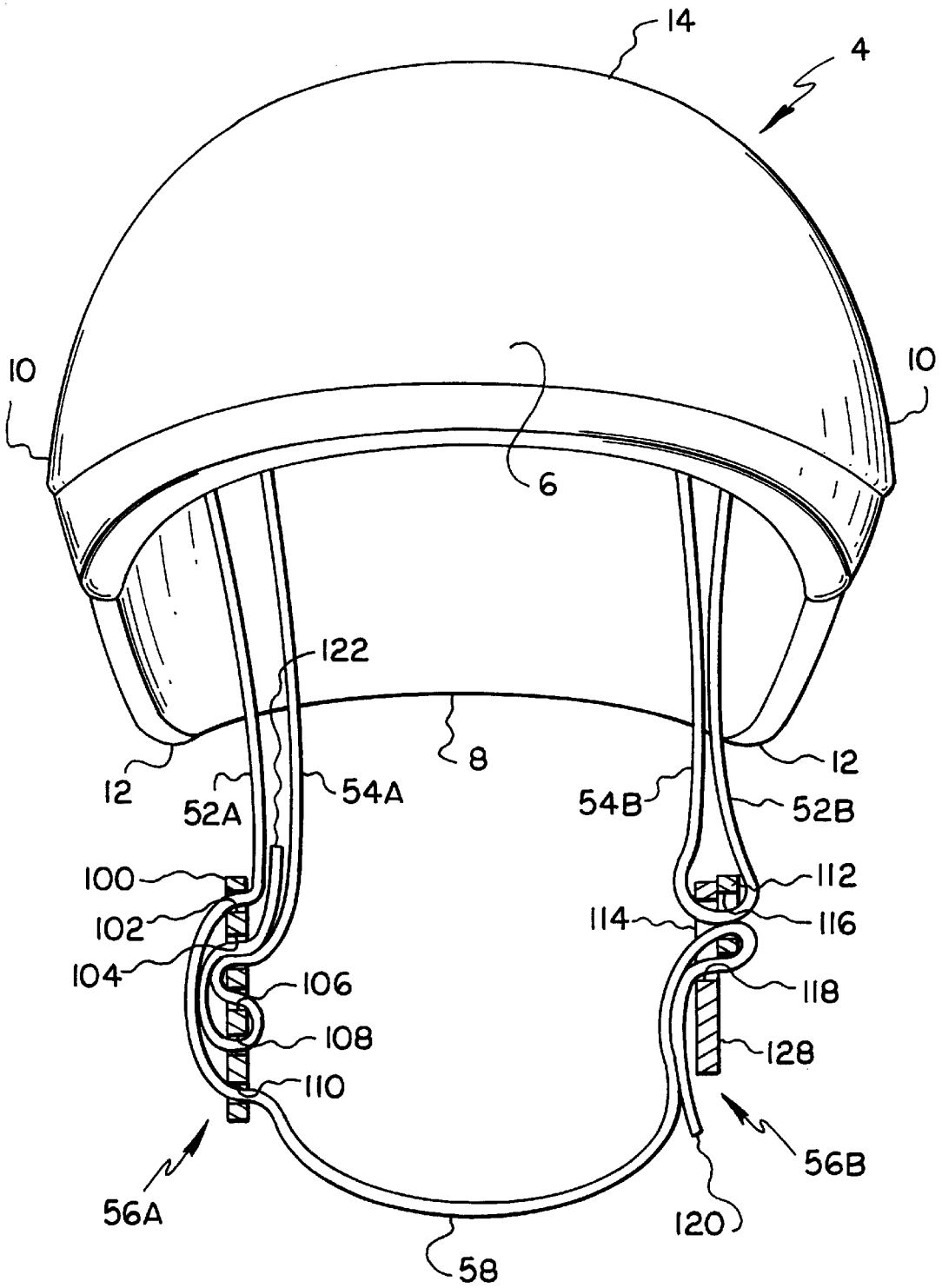
FIG. 8 is a front elevation view of headgear incorporating a closed loop, buckleless retention system in accordance with another aspect of the present invention.
Figure 9:
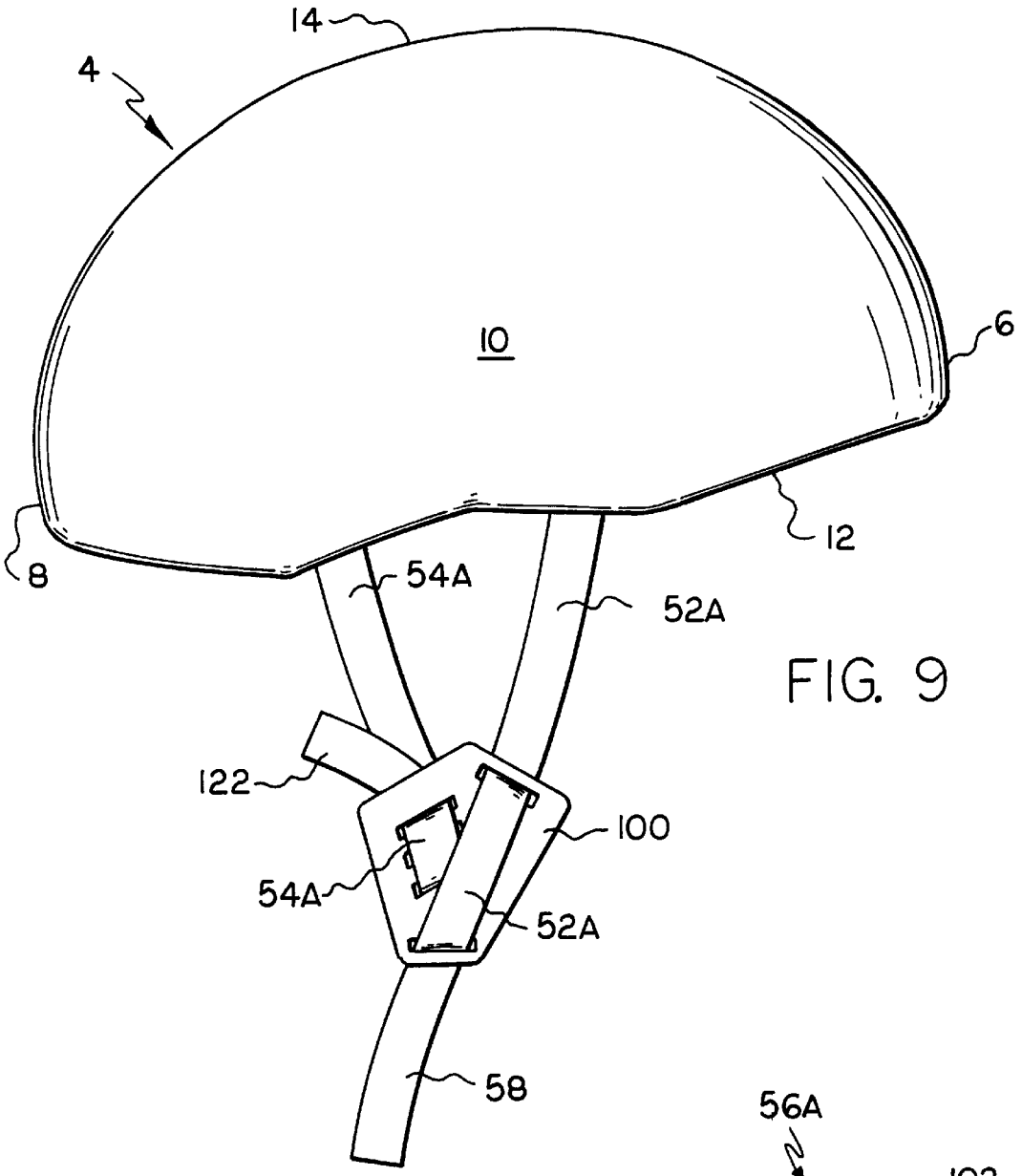
FIG. 9 is a right side elevation view of the headgear of FIG. 8.
Figure 10:
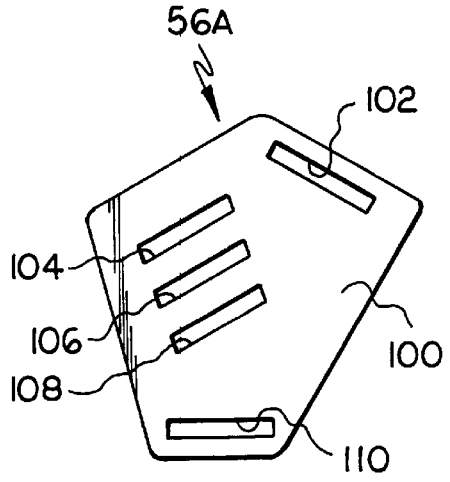
FIG. 10 is an enlarged plan view of a right-side retaining member of the retention system shown in FIG. 8.
Figure 11:
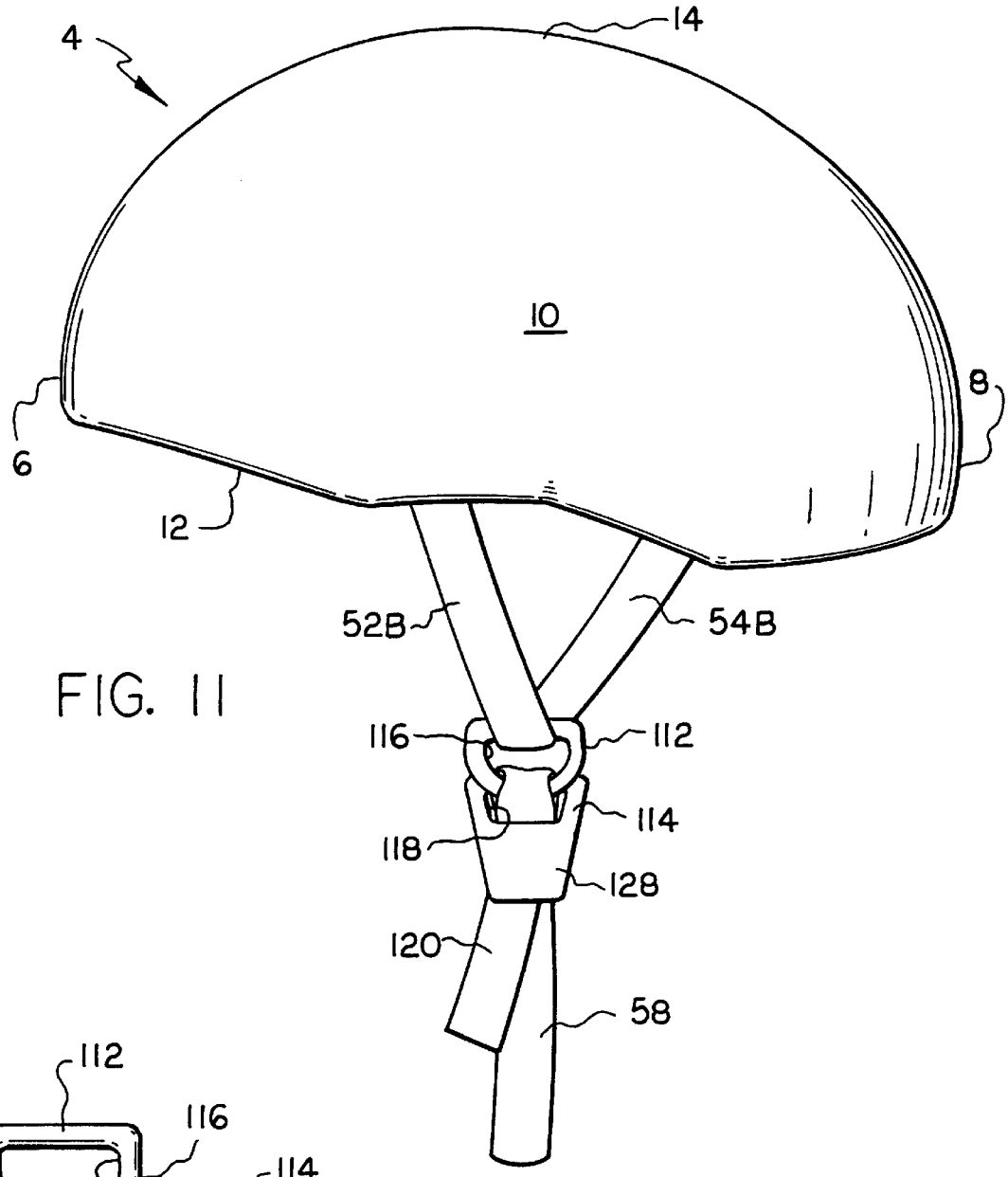
FIG. 11 is a left side elevation view of the headgear of FIG. 8.
Figure 12:
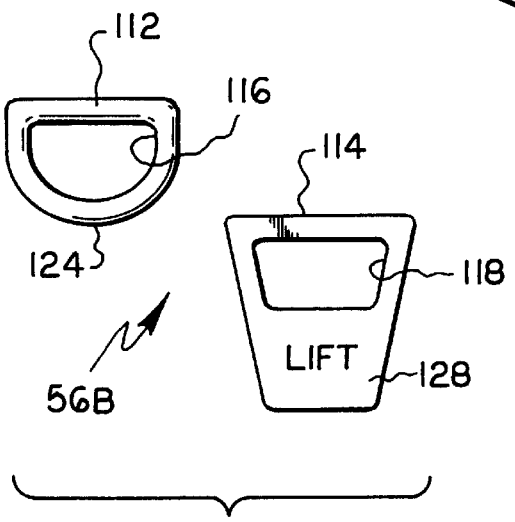
FIG. 12 is an enlarged plan view of the components of a left-side retaining member of the retention system of FIG. 8.

Turning now to the Drawing, wherein like reference numbers designate like elements in all of the several views, FIGS. 1–3 illustrate a head gear fitting and accessory system 2 constructed in accordance with a preferred aspect of the invention. FIG. 1 illustrates the system 2 in a flat assembly configuration. FIG. 2 illustrates the system 2 in an operational configuration with ends "L" and "R" folded toward each other. FIG. 3 illustrates the system 2 mounted in headgear 4. The headgear could be a bicycle helmet, an equestrian helmet or any other protective head covering. The headgear 4 includes a forward portion 6, a rearward portion 8, two lateral portions 10, a continuous lower rim 12 and an upper crown 14.

The system 2 is based on a unitary pad 16 that is flexible in nature and configured to be positioned inside the headgear 4 in such a manner as to accomplish a number of purposes, as explained below. The pad 16 may be constructed of an open-cell foam or air sac material surrounded by a cloth covering. Other convenient materials could also be used. The pad 16 is flexible to conform both to the inner surface of the headgear and to the outer surface of a wearer's head.

The pad 16 includes a lower ring-forming portion or band 18 that has a generally flat cross-sectional shape and which is configured for attachment to the headgear 4 in the area of the headgear lower rim 12. The pad 16 may incorporate one or more suspension straps extending from the band 18. In the example shown in FIGS. 1–3, there are four suspension straps designated by reference numbers 20, 22, 24 and 26. Other configurations having a greater or lesser number of suspension straps, or none at all, could also be constructed. As shown in FIG. 4, the suspension straps extend upwardly from the band 18 to reach over the top of the wearer's head. The suspension straps have attachment points at their ends, so the ends can be affixed to the headgear 4 in the area of the upper crown 14. The suspension straps suspend the headgear 4 on a wearer's head. The suspension straps 22 and 24 are forward suspension straps that extend from the band 18 in the area of the headgear forward portion 6. The suspension straps 20 and 26 are rearward suspension straps that extend from the band 18 in the area of the headgear rearward portion 8. These forward and rearward suspension straps can be (but are not necessarily) configured for placement within the headgear interior such that respective pairs of the forward and rearward suspension straps cross one another in overlapping relation near the headgear upper crown 14. Thus, forward suspension strap 22 may cross rearward suspension strap 20, and forward suspension strap 24 may cross rearward suspension strap 26.

By locating the ends of the suspension straps in different positions, so as to vary the amount of overlap of the crossing suspension straps, the wearer can achieve a desired amount of spacing between the wearer's head and the headgear 4. In one extreme, the suspension straps follow the contour of the headgear in a relaxed position, so that the headgear can rest directly on the wearer's head. At the other extreme, the suspension straps are drawn taut so that they are spaced from the headgear. In this configuration, the headgear can be positioned above the wearer's head by as much as an inch or more. The relaxed and taut positions of the suspensions straps are illustrated in detail in FIG. 6.

The suspension straps thus serve to provide a headgear suspension system that allows the wearer to raise or lower the headgear relative to the wearer's head. It should be noted that the suspension straps also permit fore and aft headgear positioning. For example, by tightening the forward suspension straps 22 and 24 relative to the rearward suspension straps 20 and 26, the headgear 4 can be positioned rearwardly on a wearer's head. By tightening the rearward suspension straps 20 and 26 relative to the forward suspension straps 22 and 24, the headgear 4 can be positioned forwardly on a wearer's head. The main advantage of the suspension straps, however, is realized in the ability to vary the forehead depths of the headgear within a given size range. In the case of children's helmets, for example, smaller children often fit too deeply into the helmets, which can cause the brow lip of the helmet to rest on the child's eyebrows or even cover their eyes.

As shown in FIGS. 1–3, the pad 16 may also be provided with one or more sizing flaps 30. The sizing flaps are pivotally connected to the band, preferably by forming seams in the cloth covering on the pad 16, which covers both the band 18 and the sizing flaps 30. These seams define discrete sections in the underlying foam or air sac material which correspond to the band 18 and the sizing flaps 30. There are preferably plural ones of such flaps extending from the band 18 in proximity to one another, with one sizing flap being disposed adjacent to the headgear forward portion 6, two sizing flaps being disposed adjacent to the headgear rearward portion 8, and two sizing flaps being disposed on the headgear lateral portions 10. Other configurations having a greater or lesser number of sizing flaps could also be constructed. The sizing flaps 30 need not be affixed to the inside of the headgear 4; they can merely rest above the band 18 against the inside of the headgear 4 when not being used to adjust the size or shape of the headgear. The sizing flaps 30 are adjustable between a folded position wherein the flaps are folded between the band 18 and the headgear 4, and an unfolded position wherein the flaps are not folded between the band 18 and the headgear 4. FIG. 4 illustrates three of the sizing flaps 30 in their unfolded positions. FIG. 5 illustrates one of the sizing flaps 30 in its folded position.

The band 18 extends essentially circumferentially around the lower inside portion of the headgear 4 and provides basic sizing according to the thickness of the pad 16. When it is desired to change the interior size or shape of the headgear 4, it is only necessary to tuck one or more of the sizing flaps downwardly under the inside of the band 18, so the flaps are positioned under the band and held in place by it. Tucking only one of the sizing flaps 30 will decrease the sizing of the headgear by a small amount; tucking several of the sizing flaps will decrease the sizing of the headgear by a larger amount. It will be appreciated that a wide variety of head sizes and shapes can be accommodated by selectively tucking and untucking the sizing flaps 30.

The pad 16 can be affixed to the inside of the headgear 4 by any convenient method, such as hook-and-loop or adhesive attachment stays. The number and location of the attachment stays are selected to (1) allow a variety of positions and arrangements of the location of the pad inside the headgear and (2) eliminate interference of the attachment points with the various folded positions of the sizing flaps on the pad.

As shown in FIG. 3, there is preferably at least one row of stays 40 that are generally adjacent to and parallel with the lower rim 12 of the headgear 4. The stays 40 engage the band 18 and releasably hold it in attachment with the headgear 4. FIGS. 4 and 5 illustrate one of the stays 40 engaging the band 18. As an alternative to the row of stays 40, a single elongated stay strip could be used.

As further shown in FIG. 3, the headgear 4 may be provided with one or more parallel rows of stays 42 and 44 extending in a forward-rearward direction in the area of the upper crown 14. The stays 42 engage the straps 24 and 26 and releasably hold them in attachment with the headgear 4. The stays 44 engage the straps 20 and 22 and releasably hold them in attachment with the headgear 4. Although two rows of stays are shown, a greater or lesser number of rows could also be used. Moreover, although multiple stays are shown in each row, there could be as few as one or two stays per row. Additionally, there need not be plural stays or rows of stays of all, it being possible to utilize one or more large stays or stay strips to secure the suspension straps. One advantage of the latter configuration is that continuous, as opposed to incremental, strap adjustment capability can be provided.

Referring now to FIG. 7, the headgear 4 preferably includes a strap retention system 50 for attaching the headgear to a wearer's head. The retention system 50 includes, on each side of the headgear 4, a forward strap 52, a rearward strap 54 and a strap retainer 56 that joins the forward and rearward straps. The forward and rearward straps 52 and 54 are mounted to the headgear 4 in conventional fashion. Extending downwardly from the strap retainers 56 is a buckleless, yet releasable, chin strap 58. The pad 16 may be provided with additional flaps 60 that extend downwardly from the band 18 at the locations where the forward retention straps 52 extend over the wearer's temples. The flaps 60 fit between the wearer's skin/scalp and the forward retention straps 52, and provide protection against pinching of the skin by the forward retention straps as the chin strap 58 is tightened under the wearer's chin. If the flaps 60 are not desired, they can be (1) tucked under the band 18, or (2) cut off for permanent removal.

For use in colder climates or seasons, the pad 16 may be provided with longer side flaps 70 which extend downwardly from the band 18 over the ears on both sides of the wearer's head, protecting the ears from wind and cold. The flaps 70 fit between the wearer's skin/scalp and the forward and rearward straps 52 and 54 of the headgear retention system 50, and are held in position by these straps. If the flaps 70 are not desired, they can be (1) tucked under the band 18, or (2) cut off for permanent removal.

As shown in FIG. 7, the pad 16 may be further provided with a flap 80 that extends downwardly from the band 18 at the rearward portion of the headgear 4. The flap 80 is formed with two slots 82 (only one of which is shown in FIG. 7) that receive a rear strap 84 of the retention system 50. The flap 80 fits over the occipital lobe of the wearer's head. The strap 84 is attached to the rearward strap 54. With the strap 84 of the retention system threaded through the slots 82, the flap 80 helps to position the retention system appropriately to hold the headgear in a stable and correct position on the wearer's head.

Turning now to FIGS. 8–14, additional details of the retention system 50 are illustrated. In FIG. 8, the strap retainers 56 are shown as including a right-side strap retainer 56A and a left-side strap retainer 56B. For reference purposes, the right-side and left-side designations are based on the perspective of the headgear wearer. The right-side strap retainer 56A is a flat body member 100 fabricated from a lightweight rigid material such as plastic, and formed with slot apertures 102, 104, 106, 108 and 110. The left-side strap retainer 56B is provided by two retainer rings 112 and 114, also made from a lightweight rigid material, having D-shaped apertures 116 and 118 formed respectively therein. For reasons which will made apparent below, the retainer ring 114 is larger than, and extends below, the retainer ring 112.

The forward and rearward straps 52 and 54 on the right side of the headgear 4 are designated by reference numerals 52A and 54A. They are each threaded through the right-side strap retainer 56A. The forward strap 52A threads through the slots 102 and 110 of the strap retainer 56A, and then extends from the strap retainer 56A to form the chin strap 58, which itself threads through the left-side strap retainer 56B and extends therefrom to form a terminal end portion 120. The rearward strap 54A threads in serpentine fashion through the slot apertures 104, 106, and 108 of the strap retainer 56A, then doubles back to thread once more through the slot aperture 104. The rearward strap 54A then exits from the strap retainer 56A to form a terminal end portion 122. It will be appreciated that the vertical position of the strap retainer 56A relative to the headgear 4 can be adjusted by changing the length of the terminal end portion 122 of the rearward strap 54A. It will also be seen, referring now to FIGS. 9 and 10, that the body member 100 and its slot apertures 102, 104, 106, 108 and 110 are configured to provide a strap separating function that assists in directing the forward and rearward straps 52A and 54A at discrete angles relative to each other.

The forward and rearward straps 52 and 54 on the left side of the headgear 4 are designated by reference numerals 52B and 54B. They are shown as being a single strap member that is looped through the D-shaped apertures 116 and 118 of the retainer rings 112 and 114 forming the left-side strap retainer 56B. The chin strap 58 also threads through the D-shaped apertures 116 and 118. More specifically, and also referring now to FIGS. 11 and 12, the chin strap threads once through both apertures 116 and 118, and then threads once more through the aperture 118 in a manner described in more detail below.

Figure 13:
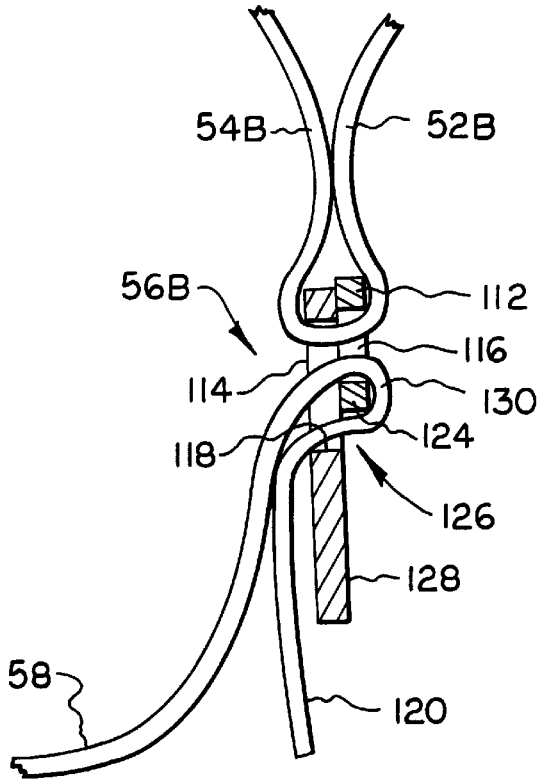
FIG. 13 is an enlarged partial front elevation view of the right side of the retention system of FIG. 8, showing the retention system in a locked configuration.

It will be appreciated that adjusting the length of the terminal portion 120 of the chin strap 58 loosens and tightens the chin strap relative to a person wearing the headgear 4. The left-side strap retainer 56B is designed so that the loosening adjustment can only be made when the retainer is manipulated by the wearer. Otherwise, the chin strap 58 will be locked against loosening movement relative to the strap retainer 56B. The components of the strap retainer 56B responsible for this self-locking action are illustrated in detail in FIGS. 13 and 14. In FIG. 13, the strap retainer 56B is shown in a locked position with the retainer rings 112 and 114 pulled into adjacent parallel relation. As stated above, the chin strap 58 is first threaded through the D-shaped apertures 116 and 118. The chin strap 58 then wraps around a lower ring portion 124 of the retainer ring 112 and threads once more through the D-shaped aperture 118 in the retainer ring 114. More specifically, after wrapping around the lower ring portion 124, the chin strap 58 extends through a passage 126 formed between the bottom of the lower ring portion 124 and the top of a lower tab portion 128 of the retainer ring 114. It will be observed in FIG. 13 that a loop portion 130 is formed as the chin strap 58 wraps around the lower ring portion 124 of the retainer ring 112.

When the headgear 4 is placed on a wearer's head, the wearer's chin will be oriented below the strap retainer 56B. When the chin strap 58 is placed in tension by tightening it under the wearer's chin, the loop portion 130 that wraps around the lower ring portion 124 pulls the retainer ring 112 downwardly and laterally toward the adjacent retainer ring 114. This causes a scissoring action between the lower ring portion 124 of the retainer ring 112 and the lower tab portion 128 of the retainer ring 114. This scissoring action serves to close the passage 126 and pinch the chin strap 58, thus maintaining it in a taut condition. Advantageously, this pinching action does not result when the wearer pulls on the terminal portion 120 of the chin strap 58. That is because the downward force placed on the terminal portion 120 is imparted to the retainer ring 114 so as to separate it from the retainer ring 112, thereby opening the passage 126 and relieving the pinching action. Thus, the chin strap 58 can be tightened by pulling on the terminal portion 120. But when the terminal portion 120 is released following tightening, the chin strap 58 will remain in its tightened state.

Figure 14:
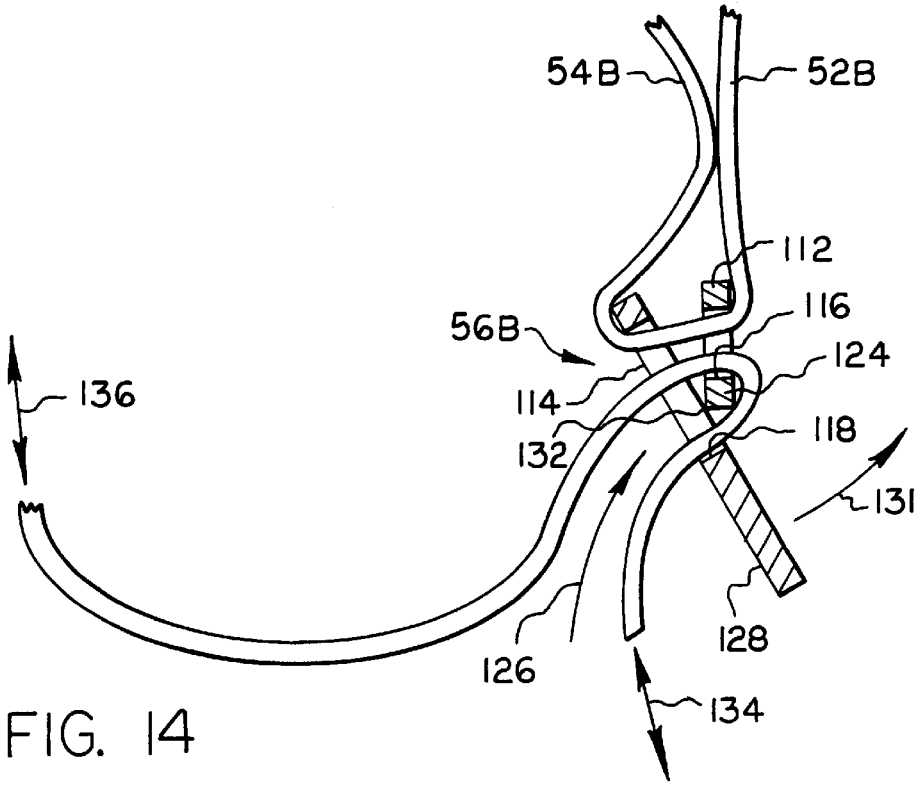
FIG. 14 is an enlarged partial front elevation view of the right side of the retention system of FIG. 8, showing the retention system in an unlocked configuration.

To release the chin strap 58 from its taut condition, the wearer pulls upwardly on the lower tab 128 of the retainer ring 114, as shown in FIG. 14 by the arrow labeled 131. This pivots the retainer ring 114 relative to the retainer ring 112 about a pivot point 132, and opens up the passage 126 so as to release the chin strap 58. The chin strap can then be adjusted in either direction as shown by the arrows labeled 134 and 136. It will be appreciated that the foregoing adjustments are performed without the use of buckles and with the retention system 50 remaining in a closed-loop condition throughout all phases of its operation.

Accordingly, a headgear fitting and retention system has been described. The system, by its soft, padded nature, provides comfort to the wearer by adding a soft, formable layer between the hard surface of the wearer's head and the hard inside surface of the headgear. The basic lower ring-forming portion or band, with none of the flaps tucked under it, is adequate to provide a reasonable level of comfort to the typical user. By selectively tucking the flaps under the band, a variety of size and shape modifications can be made. By adjusting the suspension straps, the height and fore/aft position of the headgear can be selected to suit the wearer's preference. By pulling the trailing or terminal end of the chin strap 58, the retention system can be secured and tightened without the use of buckles in a completely closed-loop environment.

While various embodiments have been disclosed, it should be apparent that many variations and alternative embodiments would be apparent to those skilled in the art in view of the teachings herein. For example, the actual layout of the pad can be altered to accommodate any size or shape of headgear, or to provide selected ones of the functions described above. For example, the pad may be formed with the suspension straps but not the sizing flaps, or with the sizing flaps but not the suspension straps. The strap retention system might also be used with a pad having no suspensions straps or sizing flaps. Any number of of decorative embellishments are possible, such as patterned fabric covers, hole patterns within the pad, or other devices. Ideally, the pad is reversible so that either surface may be affixed to the inside of the headgear, and either side may be exposed to the wearer's head. Additional functions and modifications will be apparent to those familiar with the art of headgear in light of the teachings herein. It is understood, therefore, that the invention is not to be in any way limited except in accordance with the spirit of the appended claims and their equivalents.

What is claimed is:

1. In combination with headgear having a forward portion, a rearward portion, two lateral portions, a continuous lower rim and an upper crown, a headgear fitting and accessory system, said combination comprising:

a flexible pad positioned within the interior of the headgear;

said pad including a lower ring-forming portion disposed against the headgear lower rim;

said pad further including one or more suspension straps extending from said lower ring-forming portion and disposed against the headgear upper crown; and one or more stays mounted to the headgear and releasably engaging said pad, said one or more stays providing for the securement of said pad within the headgear at a plurality of selected attachment points so as to provide variability of the length of said one or more suspension straps between their point of attachment to said ring-forming portion and one of said selected attachment points.

2. A combination in accordance with claim 1 wherein there are multiple suspension straps including forward suspension straps and rearward suspension straps respectively extending from said lower ring-forming portion of said pad at the forward and rearward portions of the headgear.

3. A combination in accordance with claim 2 wherein said forward suspension straps and said rearward suspension straps are disposed such that respective pairs of said forward and rearward suspension straps cross one another in overlapping relation near the headgear upper crown.

4. A combination in accordance with claim 3 wherein said pad is configured such that varying the amount of overlap of said forward and rearward suspension straps changes the height at which the headgear rides on a wearer's head.

5. A combination in accordance with claim 4 wherein said stays are positioned in one or more rows that are generally adjacent to and parallel with the headgear lower rim, and engage said lower ring-forming portion of said pad, and in one or more rows extending forwardly and rearwardly from the headgear upper crown, and engage said suspension straps, so that the amount of overlap of said forward and rearward suspension straps can be incrementally adjusted.

6. A combination in accordance with claim 5 wherein said suspension straps are configured for adjustment between a relaxed position wherein said suspension straps generally follow the contour of the headgear, to a taut position wherein said suspension straps are spaced from the headgear.

7. A combination in accordance with claim 1 wherein said pad further includes one or more sizing flaps pivotally connected to said lower ring-forming portion and configured for placement between a folded position wherein said sizing flaps are folded between said ring-forming portion and the headgear, and an unfolded position wherein said sizing flaps are not folded between said ring-forming portion and the headgear.

8. A combination in accordance with claim 7 wherein there are multiple sizing flaps located on said ring-forming portion of said pad at locations which allow at least one sizing flap to be disposed adjacent to the headgear forward portion, at least one sizing flap to be respectively disposed on the headgear lateral portions, and at least one sizing flap to be disposed on the headgear rearward portion.

9. A combination in accordance with claim 1 wherein the headgear further includes retention straps attached to said headgear and extending downwardly therefrom for engagement under a wearer's chin, and wherein said pad further includes pinch avoidance flaps positioned on said ring-forming member of said pad so as to extend downwardly below the headgear lower rim and between said retention straps and a wearer's head, so as to protect the wearer's head from abrasion due to said retention straps.

10. A combination in accordance with claim 1 wherein said pad further includes ear warming flaps positioned on said ring-forming member of said pad so as to extend downwardly below the headgear lower rim and over a wearer's ears, said ear warming flaps being adapted to warm the wearer's ears in cold weather.

11. A combination in accordance with claim 1 wherein the headgear further includes a closed-loop, buckleless retention system mounted to said headgear and extending downwardly therefrom for engagement under a wearer's chin.

12. A combination in accordance with claim 11 wherein said retention system includes a chin strap and a strap retainer for releasably locking said chin strap, said strap retainer comprising first and second retainer rings, said retainer rings being configured, and chin strap being threaded therethrough, to provide in combination, means for locking said chin strap against movement in a first direction while permitting movement of said chin strap in a second direction, and to further provide means for releasing said chin strap in said first direction upon pivoting said retainer rings relative to each other.

13. A headgear fitting and accessory system for use with headgear, the headgear having a forward portion, a rearward portion, two lateral portions, a continuous lower rim and an upper crown, said fitting and accessory system comprising:

a flexible pad configured to be positioned within the interior of the headgear;

said pad including a lower ring-forming portion configured for placement adjacent the headgear lower rim; and said pad further including one or more sizing flaps pivotally connected to said lower ring-forming portion and configured for placement between a folded position wherein said one or more sizing flaps are folded between said ring-forming portion and the headgear, and an unfolded position wherein said sizing flaps are not folded between said ring-forming portion and the headgear.

14. In combination with headgear having a forward portion, a rearward portion, two lateral portions, a continuous lower rim and an upper crown, a headgear fitting and accessory system, said combination comprising:

a flexible pad positioned within the interior of the headgear;

said pad including a lower ring-forming portion disposed against the headgear lower rim; and said pad further including one or more sizing flaps pivotally connected to said lower ring-forming portion and configured for placement between a folded position wherein said one or more sizing flaps are folded between said ring-forming portion and the headgear, and an unfolded position wherein said sizing flaps are not folded between said ring-forming portion and the headgear.

* * * * *